US007934406B2

(12) United States Patent
Loughlin et al.

(10) Patent No.: US 7,934,406 B2
(45) Date of Patent: May 3, 2011

(54) MULTIPLE FUNCTION LOCK

(75) Inventors: Robert Loughlin, Stanton, NJ (US); John Loughlin, Lebanon, NJ (US)

(73) Assignee: Stanton Concepts Inc., Stanton, NJ (US)

( * ) Notice: Subject to any disclaimer, the term of this patent is extended or adjusted under 35 U.S.C. 154(b) by 127 days.

(21) Appl. No.: 12/069,882

(22) Filed: Feb. 12, 2008

(65) Prior Publication Data

US 2008/0134729 A1 Jun. 12, 2008

Related U.S. Application Data

(63) Continuation of application No. 10/845,624, filed on May 13, 2004, now Pat. No. 7,434,426.

(60) Provisional application No. 60/470,999, filed on May 16, 2003, provisional application No. 60/479,742, filed on Jun. 19, 2003, provisional application No. 60/482,853, filed on Jun. 26, 2003, provisional application No. 60/512,615, filed on Oct. 20, 2003.

(51) Int. Cl.
*E05B 37/06* (2006.01)

(52) U.S. Cl. ..... 70/25; 70/21; 70/56; 70/284; 70/285

(58) Field of Classification Search ..... 70/21, 25–30, 70/38 A, 50, 52–56, 284, 285
See application file for complete search history.

(56) References Cited

U.S. PATENT DOCUMENTS 14,059 A 1/1856 Harrison, Jr.
18,169 A 9/1857 Yale
25,428 A 9/1859 Lyon
44,007 A 8/1864 Lorenz
44,757 A 10/1864 Thomson
53,096 A 3/1866 Ascherfeld
61,055 A 1/1867 Decker
81,203 A 8/1868 Pease
81,204 A 8/1868 Pease
98,917 A 1/1870 Brooks
(Continued)

FOREIGN PATENT DOCUMENTS

CN 2041340 7/1989
(Continued)

OTHER PUBLICATIONS

Tanner Corp., The Tanner Product Line, Security Fasteners, Tamper-Resistant Products, www.tannerbolt.com, Brooklyn, New York.

(Continued)

*Primary Examiner* — Suzanne D Barrett
(74) *Attorney, Agent, or Firm* — Diehl Servilla LLC; Glen M. Diehl

(57) ABSTRACT

A multiple function lock comprising an engaging element and a captive element. The engaging element enters a captive space provided in the captive element for locking the lock. The captive element includes a selectable passage into the captive space for permitting the engagement element to be selectively released or secured. The selectable passage is revealed or concealed through translation or rotation of a blocking element. In certain embodiments, the multiple function lock comprises a body, a shackle having toe and heel portions, a first locking mechanism for securing the heel portion to the body and a separate second locking mechanism for securing the toe portion to the body. The second locking mechanism is operative to engage and disengage the toe portion from the body so the shackle may rotate about the heel portion secured by the body.

15 Claims, 7 Drawing Sheets

U.S. PATENT DOCUMENTS

| | | | |
|---|---|---|---|
| 100,402 | A | 3/1870 | Hillebrand |
| 104,038 | A | 6/1870 | Kitson |
| 109,718 | A | 11/1870 | Corbett |
| 122,082 | A | 12/1871 | Van Tassel |
| 177,814 | A | 5/1876 | Delkescamp |
| 206,528 | A | 7/1878 | Bramble |
| 210,844 | A | 12/1878 | Ferret |
| 221,595 | A | 11/1879 | Mix |
| 229,003 | A | 6/1880 | Mason |
| 248,835 | A | 11/1881 | Adams |
| 256,399 | A | 4/1882 | Spielman |
| 274,875 | A | 3/1883 | Yoe |
| 280,649 | A | 7/1883 | Menzies |
| 297,445 | A | 4/1884 | Plumb |
| 374,592 | A | 12/1887 | Gilman |
| 417,602 | A | 12/1889 | Straubinger |
| 418,884 | A | 1/1890 | Bramble |
| 502,307 | A | 8/1893 | Lowrie |
| 512,979 | A | 1/1894 | Lowrie |
| 534,653 | A | 2/1895 | Lenhart |
| 549,951 | A | 11/1895 | Belanger |
| 621,391 | A | 3/1899 | Turner |
| 628,161 | A | 7/1899 | Homman |
| 686,882 | A | 11/1901 | Ballou |
| 837,295 | A | 12/1906 | Fisher |
| 858,264 | A | 6/1907 | Daugherty |
| 880,932 | A | 3/1908 | Swoggers |
| 912,773 | A | 2/1909 | Augenbraun |
| 948,853 | A | 2/1910 | Gilroy |
| 972,171 | A | 10/1910 | Dupont |
| 1,025,538 | A | 5/1912 | Roche |
| 1,092,474 | A | 4/1914 | Carroll |
| 1,222,082 | A | 4/1917 | Descalles |
| 1,284,655 | A | 11/1918 | Greber |
| 1,347,467 | A | 7/1920 | Scott |
| 1,363,599 | A | 12/1920 | Hull |
| 1,367,647 | A | 2/1921 | Washburn |
| 1,384,577 | A | 7/1921 | Swan |
| 1,527,336 | A | 9/1921 | Voda |
| 1,401,030 | A | 12/1921 | Ashkar |
| 1,424,543 | A | 8/1922 | Wiloch |
| 1,426,978 | A | 8/1922 | Gambino |
| 1,469,233 | A | 10/1923 | Messina et al. |
| 1,520,902 | A | 12/1924 | Junkunc |
| 1,618,997 | A | 3/1927 | Radandt |
| 1,659,433 | A | 2/1928 | Kroll |
| 1,689,305 | A | 10/1928 | Spano |
| 1,712,476 | A | 5/1929 | Coiro |
| 1,718,723 | A | 6/1929 | Williams |
| 1,719,309 | A | 7/1929 | Radosevic |
| 1,755,521 | A | 4/1930 | Smith |
| 1,828,747 | A | 10/1931 | Perry |
| 1,835,317 | A | 12/1931 | Miller |
| 1,857,399 | A | 5/1932 | Piagneri |
| 1,867,689 | A | 7/1932 | Van Leer |
| 1,892,964 | A | 1/1933 | Rainey |
| 1,902,665 | A | 3/1933 | Reinhold |
| 2,001,262 | A | 5/1935 | North |
| 2,079,578 | A | 5/1937 | Schlesinger et al. |
| 2,116,965 | A | 5/1938 | Schoorel el al. |
| 2,140,490 | A | 12/1938 | Wise |
| 2,159,291 | A | 5/1939 | Quintal |
| 2,163,121 | A | 6/1939 | Holtzman |
| 2,163,852 | A | 6/1939 | Pond |
| 2,179,045 | A | 11/1939 | Lewis |
| 2,185,899 | A | 1/1940 | Nehls |
| 2,248,695 | A | 7/1941 | Bradshaw |
| 2,319,753 | A | 5/1943 | Smith et al. |
| 2,362,999 | A | 11/1944 | Hewitt |
| 2,546,182 | A | 9/1947 | Fenari |
| 2,479,199 | A | 8/1949 | Bennett et al. |
| 2,488,986 | A | 11/1949 | Richter |
| 2,497,619 | A | 2/1950 | Mass |
| 2,508,302 | A | 5/1950 | Stue |
| 2,544,305 | A | 3/1951 | Finke et al. |
| 2,623,378 | A | 12/1952 | Haver |
| 2,655,805 | A | 10/1953 | Fletcher |
| 2,666,318 | A | 1/1954 | Welch |
| 2,686,447 | A | 8/1954 | Vock et al. |
| 2,770,998 | A | 11/1956 | Schwartz |
| 2,834,195 | A | 5/1958 | Stackhouse |
| 3,241,408 | A | 3/1966 | McCauley |
| 3,330,586 | A | 7/1967 | Becker |
| 3,363,500 | A | 1/1968 | Simko |
| 3,400,626 | A | 9/1968 | Bergere |
| 3,412,635 | A | 11/1968 | Chmielewski |
| 3,498,173 | A | 3/1970 | Wright |
| 3,546,906 | A | 12/1970 | Yin-Lung Yang |
| 3,572,063 | A | 3/1971 | Foote |
| 3,581,530 | A | 6/1971 | Raspadori |
| 3,584,667 | A | 6/1971 | Reiland |
| 3,592,027 | A | 7/1971 | Wako et al. |
| 3,702,551 | A | 11/1972 | Blizard |
| 3,750,431 | A | 8/1973 | Atkinson |
| 3,808,984 | A | 5/1974 | Teleky |
| 3,823,584 | A | 7/1974 | Gill |
| 3,837,189 | A | 9/1974 | Atkinson |
| 3,841,118 | A | 10/1974 | Stone |
| 3,874,258 | A | 4/1975 | Semola et al. |
| 3,952,559 | A | 4/1976 | Atkinson |
| 3,973,418 | A | 8/1976 | Close |
| 3,987,653 | A | 10/1976 | Lyon et al. |
| 4,006,660 | A | 2/1977 | Yamamoto et al. |
| 4,015,456 | A | 4/1977 | Moberg |
| 4,027,572 | A | 6/1977 | Burge |
| 4,066,195 | A | 1/1978 | Dickler |
| 4,070,879 | A | 1/1978 | Thompson |
| 4,073,165 | A | 2/1978 | Grundstrom et al. |
| 4,161,896 | A | 7/1979 | Creed |
| 4,170,918 | A | 10/1979 | Burge |
| 4,191,228 | A | 3/1980 | Fenton |
| RE30,243 | E | 4/1980 | Oliver |
| 4,211,128 | A | 7/1980 | Plumer |
| 4,216,664 | A | 8/1980 | Slavinsky |
| 4,280,726 | A | 7/1981 | McCoag |
| 4,325,240 | A | 4/1982 | Gable |
| 4,332,153 | A | 6/1982 | Miles |
| 4,351,171 | A | 9/1982 | Tsui |
| 4,483,164 | A | 11/1984 | Nielsen, Jr. et al. |
| 4,499,745 | A | 2/1985 | Ricouard et al. |
| 4,532,785 | A | 8/1985 | Uyeda |
| 4,557,122 | A | 12/1985 | Hwang |
| 4,655,062 | A | 4/1987 | Kaufman |
| 4,671,088 | A | 6/1987 | Jeang |
| 4,690,443 | A | 9/1987 | Brammall |
| 4,730,467 | A | 3/1988 | Lebrecht |
| 4,751,830 | A | 6/1988 | Cheng |
| 4,770,013 | A | 9/1988 | Nakai |
| 4,809,569 | A | 3/1989 | Erb |
| 4,823,566 | A | 4/1989 | Patton |
| 4,823,567 | A | 4/1989 | Patton |
| 4,829,795 | A | 5/1989 | Taylor |
| 4,838,052 | A | 6/1989 | Williams et al. |
| 4,841,753 | A | 6/1989 | Patton |
| 4,862,714 | A | 9/1989 | Taylor et al. |
| 4,866,958 | A | 9/1989 | Bretl et al. |
| 4,884,419 | A | 12/1989 | Ling et al. |
| 4,885,923 | A | 12/1989 | Nakai |
| 4,901,057 | A | 2/1990 | Suneborn |
| 4,918,951 | A | 4/1990 | Kavizky |
| 4,952,228 | A | 8/1990 | Taylor et al. |
| 5,020,342 | A | 6/1991 | Doan et al. |
| 5,033,279 | A | 7/1991 | Lebrecht |
| 5,134,869 | A | 8/1992 | Gable |
| 5,137,407 | A | 8/1992 | Yamamoto |
| 5,193,367 | A | 3/1993 | Ling |
| 5,195,342 | A | 3/1993 | Werner |
| 5,237,842 | A | 8/1993 | Rasch et al. |
| 5,279,190 | A | 1/1994 | Goss et al. |
| 5,347,689 | A | 9/1994 | Georgopoulos et al. |
| D352,886 | S | 11/1994 | Taylor |
| 5,361,614 | A | 11/1994 | Metcalf |
| 5,367,785 | A | 11/1994 | Benarroch |
| 5,378,101 | A | 1/1995 | Olson et al. |
| D360,125 | S | 7/1995 | Taylor |
| 5,485,734 | A | 1/1996 | Yang |
| D370,618 | S | 6/1996 | Taylor |

| | | | |
|---|---|---|---|
| 5,582,049 | A | 12/1996 | Mauer |
| 5,666,831 | A | 9/1997 | Doros |
| 5,694,797 | A | 12/1997 | Kuo |
| 5,715,709 | A | 2/1998 | Lai |
| 5,732,989 | A | 3/1998 | Stevenson et al. |
| 5,737,947 | A | 4/1998 | Ling |
| 5,749,610 | A | 5/1998 | Brammall et al. |
| 5,829,285 | A | 11/1998 | Wilson |
| 5,839,302 | A | 11/1998 | Chu |
| 5,868,012 | A | 2/1999 | Chun-Te et al. |
| 5,870,914 | A | 2/1999 | Dawson |
| 5,878,604 | A | 3/1999 | Stone et al. |
| 5,931,030 | A | 8/1999 | Chen et al. |
| 5,987,939 | A | 11/1999 | Pitisettakarn |
| 6,047,575 | A | 4/2000 | Larson et al. |
| 6,147,622 | A | 11/2000 | Fonea et al. |
| 6,173,592 | B1 | 1/2001 | Yu |
| 6,227,016 | B1 | 5/2001 | Yu |
| 6,233,984 | B1 | 5/2001 | Blehi, III |
| D450,232 | S | 11/2001 | Taylor et al. |
| 6,389,854 | B1 | 5/2002 | Huang |
| 6,408,660 | B1 | 6/2002 | Lai |
| 6,453,706 | B1 | 9/2002 | Chen |
| 6,464,269 | B1 | 10/2002 | Wilhelm et al. |
| 6,494,070 | B1 | 12/2002 | Moss et al. |
| 6,508,086 | B2 | 1/2003 | Chen |
| 6,508,089 | B1 | 1/2003 | Tsai |
| 6,513,356 | B1 | 2/2003 | Yang |
| 6,513,357 | B2 | 2/2003 | McCurry |
| 6,516,643 | B1 | 2/2003 | Olshausen |
| 6,539,761 | B2 | 4/2003 | Yang |
| 6,546,763 | B1 | 4/2003 | Pielach |
| 6,546,764 | B2 | 4/2003 | Segawa |
| 6,584,819 | B1 | 7/2003 | Hung |
| 6,598,434 | B2 | 7/2003 | Yang |
| 6,604,393 | B2 | 8/2003 | Larsen et al. |
| 6,708,534 | B1 | 3/2004 | Ruan |
| 6,722,166 | B2 | 4/2004 | Skjellerup |
| 6,725,692 | B2 | 4/2004 | Weinraub |
| 6,729,166 | B1 | 5/2004 | Lai |
| 6,739,796 | B1 | 5/2004 | Del Nero et al. |
| 6,766,673 | B2 | 7/2004 | Gast et al. |
| 6,843,080 | B1 | 1/2005 | Yu |
| 6,848,283 | B1 | 2/2005 | Lin |
| 6,860,125 | B1 | 3/2005 | Yu |
| 7,021,092 | B2 | 4/2006 | Loughlin et al. |
| 7,193,503 | B2 | 3/2007 | Fisher |
| 2001/0039818 | A1 | 11/2001 | Jones et al. |
| 2002/0088256 | A1 | 7/2002 | Taylor et al. |
| 2002/0129628 | A1 | 9/2002 | Skalberg |
| 2002/0139155 | A1 | 10/2002 | Franzen |
| 2003/0089147 | A1 | 5/2003 | Yang |
| 2004/0083782 | A1 | 5/2004 | Lantz |
| 2004/0226323 | A1 | 11/2004 | Ling et al. |
| 2005/0034492 | A1 | 2/2005 | Yu |
| 2005/0039500 | A1 | 2/2005 | Yu |
| 2005/0039501 | A1 | 2/2005 | Yu |
| 2005/0044900 | A1 | 3/2005 | Yu |
| 2005/0044901 | A1 | 3/2005 | Yu |
| 2005/0044902 | A1 | 3/2005 | Yu |
| 2005/0044903 | A1 | 3/2005 | Ling et al. |
| 2005/0235705 | A1 | 10/2005 | Ling et al. |
| 2005/0235706 | A1 | 10/2005 | Ling et al. |

FOREIGN PATENT DOCUMENTS

| | | |
|---|---|---|
| CN | 590146 | 6/2004 |
| JP | H7-217293 A | 8/1995 |
| JP | H7-217294 A | 8/1995 |

OTHER PUBLICATIONS

Cross Check Bolt Seal and Hydro Check Removal Tool, Tyden Brammall, 409 Hoosier Drive, Angola, IN 46703.

Palos Sports, StopLock, Rotary dial combination school lock, www.palossport.com/store/proddetails.cfm/itemID/1667/CategoryID/7081/SubCatID/0/file.htm.

E. J. Brooks Company, Resuable Trans-Lok Seal ä www.ejbrooks.com, Livingston, New Jersey, Apr. 13, 2003.

U.S. Appl. No. 60/443,331, filed Jan. 29, 2003.

McGard Special Products Division, Innovative Security Solutions, The Intimidator, Orchard Park, New York, Revised Jun. 2002.

Columbia Sportsware Company—Adventure Gear Fall 2003/Spring 2004 Catalog, pp. 1-10, Nov. 2002.

MULTIPLE FUNCTION LOCK

CROSS REFERENCE TO RELATED APPLICATIONS

The present application is a continuation of U.S. patent application Ser. No. 10/845,624 filed May 13, 2004, which claims the benefit of the filing dates of U.S. Provisional Patent Application Ser. Nos. 60/470,999 filed May 16, 2003; 60/479,742 filed Jun. 19, 2003; 60/482,853 filed Jun. 26, 2003; and 60/512,626 filed Oct. 20, 2003, the disclosures of which are hereby incorporated herein by reference as if fully set forth herein.

BACKGROUND OF THE INVENTION

Conventional locks, such as padlocks employing U-shaped shackles, are extremely popular. One reason for their popularity is the ease and convenience of their attachment to, and fit with, the hasps and other attachment mechanisms of devices with which they are used to provide for the unlatching and opening of the secured assembly.

The latching and locking functions of conventional locks most often involve the manipulation of an engaging element with respect to a captive element. The captive element typically includes a captive space, or cavity, within which the engaging element may be secured. When secured, the lock is locked and when unsecured the lock is unlocked. Conventional engaging elements are commonly referred to as a shackles or bolts, depending on the category of lock being described. Nevertheless, conventional shackles and bolts generally work off identical principles known in the art.

The locks most frequently in use today rely on a single locking mechanism, most typically being operated by a key. Other locks rely on keyless locking mechanisms, such as combination locks. Notwithstanding, some applications require multiple function locks combining both key and combination functions. Dual locking locks combining two key functions are also known. Such multiple function locks typically allow for the opening of the lock by one of two methods, namely, by either one of the multiple locking functions being unlocked independently or by both of the multiple locking functions being unlocked together. Those locks that require manipulation of multiple locking functions together are often referred to as multiple custody locks, in that two custodians are typically utilized. In any event, each of the opening methods typically manipulates one locking mechanism which serves to move the engaging element into or out of the captive space provided by the captive element.

Alternative mechanisms offering locking functions that rely on neither keys nor combinations are also known. These mechanisms require specialized tools to unlock and release the secured elements and find very limited application outside of very specialized markets.

Tamper indicative devices such as PRIVASEAL® brand protective seals have been in use since ancient times as one time use security elements to provide evidence of tampering or access to secured objects. PRIVASEAL® is a registered trademark of Stanton Concepts, Inc., P.O. Box 139, Stanton, N.J. Locks incorporating seals as part of the security function in combination with key or keyless (combination) mechanisms are known. The seals are typically incorporated into the conventional locks such that the integrity of the seal is compromised upon opening or attempted opening of the lock to indicate access or tampering. Preferably, the seal is arranged such that tampering is readily apparent upon initial visual observation.

Today, travel safety concerns, particularly air travel safety concerns, mandate that security authorities have access to checked luggage. However, many travelers secure their luggage with locks designed only for their own personal use. These locks may be provided with key or keyless (combination) function. Lacking the appropriate key or combination, authorized security personnel may be required to open the lock destructively.

The issue of nondestructive access has created the need for a new class of dual function locks. This new lock concept would permit the traveler to have the security and ease of use available from the traditional lock and, in addition, provide the appropriate authority with the ability to open and close the lock nondestructively, and independently from the traditional locking mechanism. This alternative function may provide credible security by being difficult to circumvent. In addition, the option for control and tracking of the opening event may be available by the use of tamper indicative devices, such as PRIVASEAL® protective seals. Such seals may be incorporated in a manner to reveal the operation of the alternative security function and/or the traditional locking elements.

The prior art is abundant with clever solutions to these problems used independently or in limited combination. However, none of the prior art devices combine these multiple features and functions as revealed herein. The subject invention combines various conventional security functions with novel developments to solve the new requirement for separate and discrete access to a single secured lock.

Thus, it would be advantageous to provide a novel lock, and specifically a novel multiple function lock using key, keyless (combination), alternative mechanisms or tamper indicative seals, singly or in combination, to provide for secure control of the opening and closing of the lock through various means which may be employed independently of each other.

SUMMARY OF THE INVENTION

The multiple function lock of the present invention is designed to overcome the deficiencies of the prior art. Several objectives and advantages of this invention follow from the novel method by which the traditional security functions are achieved using multiple security elements in combination. The traditional captive element incorporates a captive space within which an engaging element, shackle toe, lock bolt or the like, may be selectively inserted to lock or unlock the lock. The lock may be unlocked, unlatched and opened by manipulating a locking mechanism to move the engaging element. The locking mechanism is preferably a conventional locking mechanism known in the art, such as a keyed mechanism or a combination mechanism.

A novel second method for freeing the engaging element to permit opening of the lock without utilizing the traditional locking mechanism is also presented herein. This may be achieved by moving a blocking element, either through translation or rotation, to selectively reveal a passage through which the engaging element may pass independent of the locking mechanism. This movement may be introduced by use of a specialized tool that engages the restricting component and provides for its realignment, rotation, shifting, or the like, disengaging the engaging element from within the captive element, thus permitting the lock to be opened. This realignment motion may also be achieved by use of an independent conventional locking element when such is appropriate to the application. The action may be reversed to return the engaging element to the engaged, locked, and secure position with the captive element.

This invention includes several families of means to achieve the result described. The embodiments provide a range of sizes and variety of functional elements used singly or in combination to meet the requirements of the applications.

In one embodiment of the present invention, a multiple function lock may comprise an engaging element and a captive element. The engaging element may be adapted to enter a captive space provided in the captive element for locking the lock. The captive element may have a selectable passage into the captive space for permitting the engagement element to be selectively released or secured.

The selectable passage may be revealed or closed through translation of a blocking element. The translation of the blocking element may be achieved by use of a tool. The tool may be a key. The tool may utilize mechanical advantage to translate the blocking element.

The selectable passage may be rotated to selectively release or secure the engagement element. The rotation may be achieved by use of a tool. The tool may be a key. The tool may utilize mechanical advantage to rotate the selectable passage.

The lock may be a padlock.

The lock may be permanently incorporated into a piece of luggage.

The engaging element may be operable by use of a tool. The tool may be a key. The tool may be a power tool.

The engagement element may be operable by a combination mechanism.

In another embodiment, a multiple function lock may comprise a body, a shackle having toe and heel portions, a first locking mechanism for securing the heel portion to the body and a separate second locking mechanism for securing the toe portion to the body.

The first locking mechanism may be operative to engage and disengage the heel portion from the body such that the shackle may rotate about the heel portion secured by the body. The second locking mechanism may be operative to engage and disengage the toe portion from the body such that the shackle may rotate about the heel portion secured by the body.

The second locking mechanism may be operative to engage and disengage the toe portion from the body such that the shackle may rotate about the heel portion secured by the body.

At least one of the locking mechanisms may be a keyed cylinder.

At least one of the locking mechanisms may be a combination lock.

The second locking mechanism may comprise a retaining member, the retaining member having a recess for receiving the toe portion, the retaining member being moveable between an unlocked position at which the toe portion is free to rotate about the heel portion and a locked position at which the toe portion is received within the recess of the retaining member to restrict rotation thereof. The retaining cup may extend from the body in the locked position.

The body may include an opening extending therein, the second locking mechanism including a latching portion adapted to be slid within the opening to engage the toe portion, and the toe portion further including a recess adapted to receive the latching portion, the latching portion having a locked position at which the latching portion extends from within the body into the recess to engage the toe portion.

The second locking mechanism may comprise a rotatable element mounted on the body, the rotatable element having an opening permitting selective passage of the toe portion when the opening is rotated to an unlocked position to align the opening with a path of rotation of the toe portion about the heel portion, the rotatable element having a locked position at which the opening does not align with the path of rotation of the toe portion about the heel portion.

The second locking mechanism may be actuatable by any one of a key or a tool. The actuation by a key or a tool may initiate translation or rotation of the second locking mechanism.

The body and the heel portion may form an aperture adapted to receive a tamper evident element. The tamper evident element may be passed through the aperture.

The body and the toe portion may form an aperture adapted to receive a tamper evident element. The tamper evident element may be passed through the aperture.

The lock may be adapted to accept an adhesive label applied thereto, the label adapted to rupture upon manipulation of the second locking mechanism.

The second locking mechanism may comprise a rotatable element mounted within the body, the rotatable element having an interrupted portion permitting selective passage of the toe portion when the interrupted portion is rotated to an unlocked position to align the interrupted portion with a path of rotation of the toe portion about the heel portion, the rotatable element having a locked position at which the interrupted portion does not align with the path of rotation of the toe portion about the heel portion.

The locking mechanism may comprise a frangible element securing the toe portion, the frangible element adapted to be fractured upon the application of a sufficient force thereupon. The application of force may be by rotation of the shackle about the heel portion. The frangible element may include locally weakened areas to control the fracture characteristics of the frangible element. The frangible element may further comprise a pull tab adapted to fracture the frangible element upon pulling of the pull tab.

In a still further embodiment of the present invention, a multiple function lock may comprise a body, a unshaped shackle having toe and heel portions, the heel portion rotatably secured within the body, a combination locking mechanism for securing the heel portion, the combination locking mechanism having a locked position in which the heel portion is retained within the body but is free to rotate and an unlocked position in which the heel portion may be lifted from within the body, a second locking mechanism comprising a keyed cylinder operationally engaged with a retaining cup, the keyed cylinder having a locked position in which the retaining cup retains the toe portion therein and an unlocked position in which the retaining cup does not retain the toe portion therein.

The retaining cup may be within the body in the unlocked position of the keyed cylinder.

The retaining cup may further include a passage adapted to permit entry and exit of the toe portion in the unlocked position of the keyed cylinder. The retaining cup may rotate between the unlocked position and the locked position.

The second locking mechanism may protrude from a top side of the body in the locked position of the second locking mechanism and a bottom side of the body in the unlocked position of the second locking mechanism.

In a further embodiment of the present invention, a tool for opening a lock of the type having a first locking mechanism for securing the heel portion of a shackle and a second locking mechanism for securing the toe portion of the shackle is provided, the tool may be adapted to lock and unlock the second locking mechanism. The tool may incorporate an element adapted to selectively rotate the second locking mechanism to lock or unlock the toe portion of the shackle.

The tool may further comprise a ratcheting assembly operative to impart incremental force upon the lock to unlock the second locking mechanism. The tool may be power operated. The power may be one of electrical power, pneumatic power, or hydraulic power.

In a still further embodiment of the present invention, a tool having a structure unique to opening one of the first or second locking mechanisms of a multiple function lock, wherein the first locking mechanism is adapted to selectively engage a captive element within a captive space and the second locking mechanism is adapted to disengage the captive element from within the captive space independent of the first locking mechanism is disclosed.

In yet another embodiment of the present invention, a method of opening a lock having two manners of opening, one of the manners adapted to unlock the heel portion of a shackle and the second adapted to unlock the toe portion of the shackle, the method comprising the step of opening one of the two manners of opening is disclosed.

The method may further comprise maintaining one manner of opening as exclusive to a particular group of individuals.

In a further embodiment of the present invention, a combination of a lock and a tool is disclosed, wherein the lock may comprise a body and a shackle having toe and heel portions, a first locking mechanism for securing the heel and the toe portions to the body and a separate second locking mechanism for securing the toe portion to the body, the tool may be adapted to lock and unlock the second locking mechanism.

In another embodiment of the present invention, a method of inspecting containers locked with a multiple function lock comprising an engaging element and a frangible captive element is disclosed. The engaging element may be adapted to enter a captive space provided in the captive element for locking the lock, the captive element being frangible such that fracture of the captive element unlocks the lock. The method may comprise fracturing the frangible element, opening the container for inspection of the contents therein, closing the container.

The method may further comprise replacing the frangible element with an intact frangible element, placing the captive element into a space provided in the intact captive element. The method may further comprise sliding the intact frangible element partially up the engaging element to assist with the replacement of the frangible element with an intact frangible element. The intact frangible element may be visually distinct from the fractured frangible element. The visual distinction between the fractured frangible element and the intact frangible element may be color differentiation. The visual distinction between the fractured frangible element and the intact frangible element may be due to distinct markings. The distinct markings may be alphanumeric. The distinct markings may be bar codes. The distinct markings may be symbols, logos or other insignia. The intact frangible element may include a radio frequency identification tag.

The method may further comprise placing the lock within the container. The method may further comprise the step of sealing the container with a protective seal.

In a further embodiment of the present invention, a kit for housing locks adapted to permit selective access to a container is disclosed. The kit may comprise a multiple function lock having a body, a shackle having toe and heel portions, a first locking mechanism for securing the heel portion to the body and a separate second locking mechanism for securing the toe portion to the body, the second locking mechanism comprising of a frangible element, the frangible element adapted to be fractured and discarded upon the application of a sufficient force thereupon, and at least one additional frangible element to replace any fractured frangible elements.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

In regard to the drawings.

DETAILED DESCRIPTION

Figure 1A:
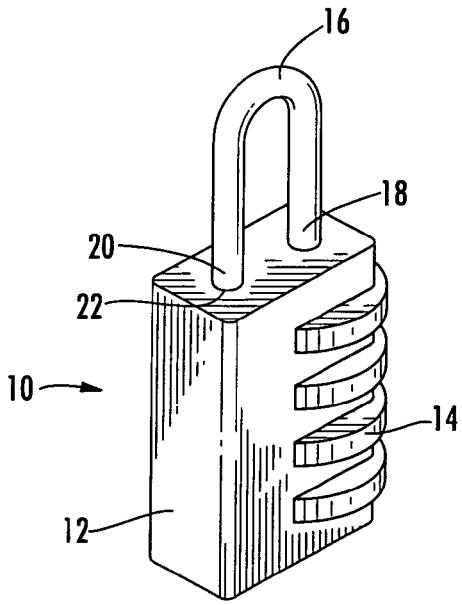
FIG. 1a (PRIOR ART)
FIG. 1*a* is perspective view of a conventional lock shown in the locked position.

In the following is described the preferred embodiments of the multiple function lock. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

It will become evident to one skilled in the art that several objectives and advantages of this invention follow from the novel method by which the traditional security functions are achieved using multiple security elements in combination. In conventional locks, the key or combination locking and latching function engage the heel of the U-shaped shackle within the lock body to provide security. The lock may be unlocked, unlatched and opened by manipulating the locking mechanism, lifting the shackle to free the toe from a cavity provided in the body and rotating the toe away from the body.

A second method for freeing the toe to permit the rotation of the shackle to the open position without the traditional lifting motion is presented herein. This is achieved by moving the restricting cavity or restricting component out of engagement with the toe of the shackle. This motion may be achieved by use of a specialized tool that engages the restricting component and provides for its realignment or shifting. This movement disengages the shackle from the body at the toe permitting the shackle to be rotated to the open position. This realignment motion may also be achieved by use of an independent conventional locking element when such is appropriate to the application. The action is reversed to return the shackle to the engaged, locked, and secure position.

In other embodiments, the tool may be utilized to unlock a first locking mechanism to reveal a second locking mechanism, rather than to open the lock directly. The general concept of revealing a second mechanism is known in the art and finds utility in providing multiple levels of security within a single unit. Often, locks with the general feature are known as "trick" locks. However, here, one of the multiple locking mechanisms may be independent from the others and may operate in accordance with the novel teachings of this invention. Multiple separate locking mechanisms may be incorporated into a single lock. As applied to certain embodiments of the present invention, the specialized tool may therefore be utilized to unlock and reveal a subsequent locking mechanism, where the subsequent locking mechanism is operative to free the toe of the shackle. In other embodiments, the sequence of locking mechanisms may be altered, such that the tool is not necessarily the final locking mechanism manipulated to unlock the toe of the shackle.

This invention includes several families of means to achieve the result described. The embodiments provide a range of sizes and variety of functional elements used singly or in combination to meet the requirements of the applications.

Additionally, the present invention permits the exploitation of several advantages. The conventional well-known small (privacy) class of locks provide low cost, well-tooled, efficiently manufactured, and functionally reliable locking mechanisms using either a key or keyless (combination) mechanisms. These locks find very wide acceptance in today's travel market. It would be advantageous to adapt a similar sized and strength lock to include the features of the present invention.

In addition, conventional well-known tamper indicative devices (seals) of several styles are available providing various advantages when used in combination with locking mechanisms. Label seals offer the opportunity to provide unique identification for both the seal and the operator applying the seal. This information could include location, date, time and other appropriate application data indicating information relating to the opening of the lock. Other frangible seals may be used to augment the security and control required by specific applications. The seals could provide indication of motion or shifting between various elements of the locking mechanism as appropriate to indicate tampering. An example of these types of seals are the PRIVASEAL® protective seals offered by Stanton Concepts.

It will be appreciated that when used herein, the term tool shall be construed broadly to include at least those devices used to facilitate manual or mechanical work, such as instruments or apparatuses used in performing an operation or which are necessary for the practice of a vocation. The definition of tool shall be construed broadly to include devices which incorporate a mechanical advantage and/or structure to withstand a torsional or other force implemented to initiate the mechanical advantage, as well as devices which do not incorporate a mechanical advantage, such as tools utilizing the principles of electronics, magnetism, or the like. The tools may also be power driven such as a conventional drill or the like.

One subset of tools are keys. Keys shall be construed more narrowly than tools herein to include only conventional keys having differentiated patterns, or bitting, and which are adapted to manipulate a lock mechanism without the influence of a substantial mechanical advantage. Examples of such keys are those used to operate conventional pin tumbler cylinder locks.

Referring now to the figures, FIG. 1*a* depicts a conventional lock 10, as known in the art. Such locks 10 are often referred to as padlocks. The lock 10 of FIG. 1*a* is shown in the locked position. Such locks 10 generally comprise a body 12 having a locking mechanism 14 therein. The locking mechanism shown in FIG. 1*a* is a keyless (combination) lock. Other mechanisms, such as keyed cylinders or other tool operated mechanisms, are also known in the art, and may be utilized effectively with the present invention. A U-shaped shackle 16 may be rotatably engaged to the body 12 at its heel 18. As known in the art, the locking mechanism 14 typically engages the heel 18 to selectively lock or unlock the lock by capturing the heel when the heel is pushed into the body 12.

In conventional locks other than padlocks, the locking elements, though with similar function, are often referred to utilizing different terminology than described with respect to padlocks. Broadly, the engaging element is often referred to as a bolt or latch. In order to lock or unlock the lock, the engaging element is adapted to be received by a captive element, or more specifically a captive space formed within a captive element. This captive element is often referred to as a strike.

Using a conventional deadbolt for a door as an example, the deadbolt itself is the bolt and the strike is that area on the door jamb which the deadbolt enters when locked, and exits when opened. The strike area is typically defined by a metallic plate having an opening therethrough. No matter the terminology used or the function or field of operation of the lock, the present invention is intended to be construed broadly to incorporate the elements described as engaging elements and captive elements.

Figure 1B:
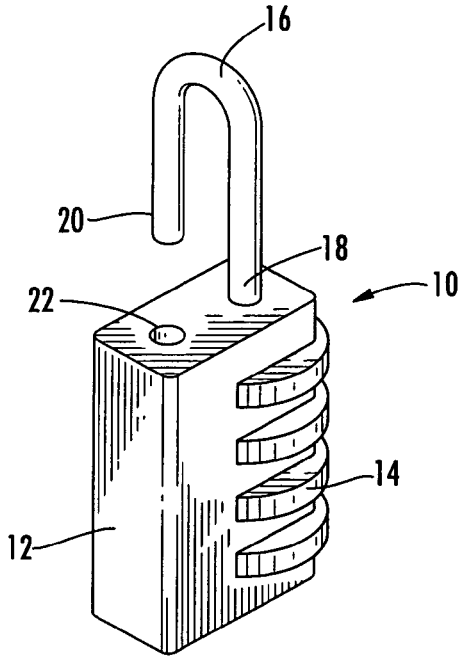
FIG. 1b (PRIOR ART)
FIG. 1*b* is a perspective view of the conventional lock of FIG. 1*a* shown in the unlocked position.

Referring back to the figures, in a conventional lock, the toe 20 of the shackle 16 may be retained by a retaining cup 22 when the shackle is locked. The retaining cup 22 is more clearly shown in FIG. 1*b*, which depicts the lock 10 of FIG. 1*a* in an unlocked and opened position. The retaining cup 22 is typically a simple recess machined or cast into the body 12 of the conventional lock 10. Upon unlocking the lock 10, the heel 18 is released from within the body 12 allowing the shackle 16 to be lifted so the toe 20 may be rotated away from the retaining cup 22.

In a conventional lock 10, the heel 18 of the shackle 16 is typically captured within the body 12 by operation of the locking mechanism 14. While the heel 18 of a conventional lock 10 is locked by capture and engagement within the body 12 by portions of the locking mechanism 14, the shackle is typically free to rotate about the heel, and is only prevented from doing so by blocking of the toe 20 by the retaining cup 22. Heretofore, this feature of a conventional lock has not been exploited as in the present invention.

As such embodiments of the present invention incorporate the features of conventional locks with novel improvements to achieve the secure control of the toe 20 of the shackle 16 in addition to the secure control of the heel 18. Securement of the toe 20 in addition to, and independent from, securement of the heel 18 provides a totally independent and alternate method of locking and unlocking the lock 10.

Figure 2A:
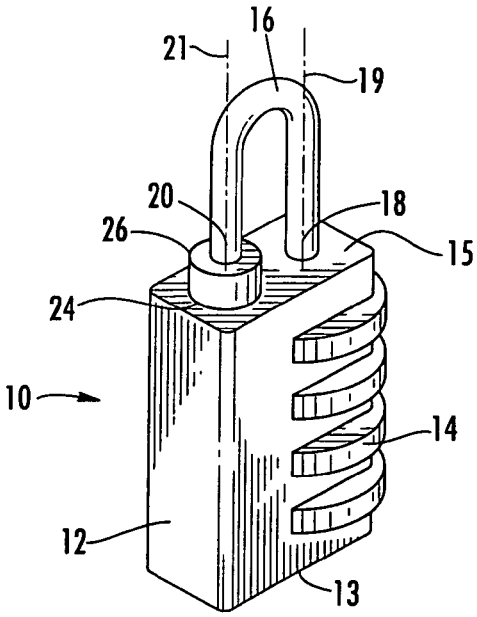
FIG. 2*a* is a perspective view of a multiple function lock in accordance with one embodiment of the present invention shown in the locked position.
Figure 2B:
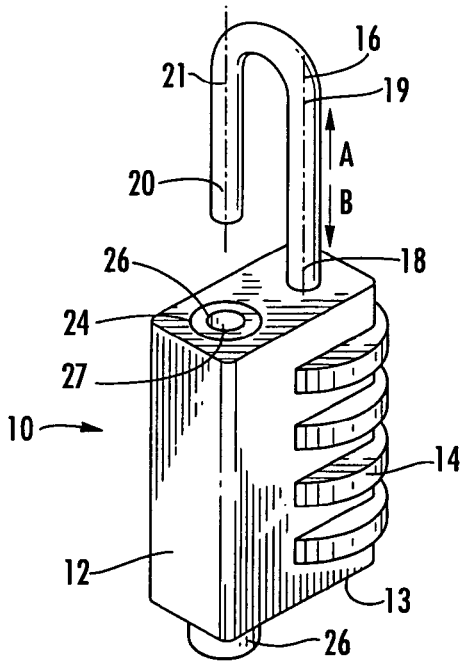
FIG. 2*b* is a perspective view of the multiple function lock of FIG. 2*a* shown in the unlocked position.

In a preferred embodiment shown in FIGS. 2*a* and 2*b*, the lock body 12 includes a clearance hole 24 at the point where the centerline 21 of the toe 20 intersects the top 15 of the body when the lock 10 is in the locked position. The clearance hole 24 preferably extends through the entire length of the body 12. As with conventional locks, motion along the long axis 19 of the heel portion 18 of the shackle 16 is required to engage or disengage the traditional latching and locking elements 14 within the body 12. This is considered the vertical motion option, and is shown in FIG. 2*b* by direction arrows A and B. It will be appreciated that movement of the shackle 16 in the direction indicated by arrow A will unlock the lock 10 while movement in the direction indicated by arrow B will lock the lock. This conventional function is preserved throughout the embodiments of this invention and operates in the normal manner of conventional locks.

The clearance hole 24 houses a cylinder 26 to enclose and capture the toe 20 of the shackle 16 as shown in FIG. 2*a*. The cylinder 26 provides an inside clearance or bore 27 (FIG. 2*b*) to accept the toe 20 of the shackle 16 and an outside diameter to permit a wall thickness sufficient to assure the security of the engaged toe against aggressive assaults. As used herein, the term bore (or derivations thereof) shall be construed to broadly include holes, cavities, depressions, apertures, passages or the like, in general. Such bores may be created by means other than by the use of a drill or similar device, including, but are not limited to, being cast or formed in or by a mold, frame or other apparatus.

The bored engaging cylinder 26 is typically constructed to fit tightly within the clearance hole 24 in the body 12 of the lock, and is of a length such that it may extend from within the body either toward the toe 20 of the shackle 16, when the lock is locked (FIG. 2*a*), or from the base 13 of the body 12 when the lock is unlocked (FIG. 2*b*). The hole 24 is preferably concentric and in alignment with the centerline 21 of the toe portion 20 of the shackle 16. The cylinder 26 is typically sized to be longer than the height of the body 12 of the lock 10. However, it may actually be shorter than the body 12 and still work effectively.

As noted, the bored engaging cylinder 26 is free to move vertically along its centerline 21 a sufficient distance to disengage from the toe 20 of the shackle 16. The disengaged toe 20 is then released and is free to rotate about the centerline 19 of the heel 18 as shown in FIG. 2*b*. The heel 18 remains engaged, latched and locked within the body 12 of the lock 10 in the conventional manner. The open shackle 16 may then be engaged or disengaged with a hasp or other attachment (not shown) as desired by the user. The lock 10 can be returned to the locked and secure position by aligning the free toe 20 with the bored cylinder 26 and returning the cylinder to its locked position, engaging the toe 20 of the shackle 16, as shown in FIG. 2*a*.

Of course, the traditional locking mechanism 14 retains its function. In this regard, even when the cylinder 26 is in its advanced position retaining the toe 20, the heel 18 may be unlocked and lifted such that the toe 20 is no longer retained by the cylinder 26 even though the cylinder remains in the locked position shown in FIG. 2*a*. The toe 20 may then be rotated away from the body 12 of the lock 10.

In its simplest form, the cylinder 26 is merely a stainless steel roll pin, as is commonly available and is known in the art. Stainless steel roll pins are also commonly referred to as slotted spring pins or coiled spring pins. Each of those terms will be used interchangeably herein. Such roll pins may be selected from readily available stock, or may be custom made to fit the particular diameter of the clearance hole 24 and length of the lock body 12, and to have the wall thickness desired. Because of their natural tendency to expand or unroll, roll pins provide a friction force between the roll pin and the clearance hole 24. Preferably, the friction force is sufficient to require the use of a specialized tool to overcome the friction forced required to shift the roll pin. It will be appreciated that the end of the roll pin itself may form the bore 27 required to accept the toe 20. As previously discussed, it will also be appreciated that the bore 27 is not limited to bores in the traditional sense, but may include any structure sufficient to capture the toe 20, such as recesses, dimples, openings and the like. The bore 27 also may be incorporated into a separate element attached to the roll pin 26.

Rather than being formed from a roll pin, the cylinder 26 may also be formed from a conventional machined pin. Such machined pins are typically solid pins and are well known in the art. The machined pin may include a recess or bore 27 at its end nearest the toe 20 to accept the toe and capture the toe therein. The friction level between the machined pin and the clearance hole 24 may be controlled by use of various materials, as well as by adjusting the size of the machined pin or the hole. The greater the level of friction, the greater the security level of the toe 20 release function of the lock 10, as larger forces are required to overcome the frictional resistance.

Locks 10 of the type disclosed in this embodiment may be formed or otherwise retrofitted directly from some conventional locks by a simple two-step retrofitting process. The process includes boring a clearance hole 24 through the body 12 of a conventional lock 10 of the type shown in FIGS. 1*a* and 1*b*. Once the clearance hole 24 is bored, the appropriately sized roll pin or machined pin 26 may be inserted, thus forming a lock of the type depicted in FIGS. 2*a* and 2*b*. The toe 20 of shackle 16 may also require modification to fit within the machined pin 26. Such modification may include removing material to reduce the overall diameter of the toe.

Whether a machined pin or a roll pin, the cylinder 26 may also be provided with a separate retaining cup (not shown) to capture the toe 20 of the shackle 16. If so provided, the retaining cup will generally sit upon the cylinder 26 such that it may engage the toe 20 of the shackle 16. The retaining cup may be formed from materials similar to that of the cylinder 26, such as stainless steel, or may be formed from other desired materials, such as brass or plastic.

Although the heel 18 may be unlocked in the conventional manner, a special tool is typically required to release the toe 20 in the novel manner provided by this embodiment of the invention. Simple tools, such as keys, may provide the requisite manipulation to shift the cylinder 26 within the clearance hole 24. More intricate tools are advantageous however, because they may assert greater force upon the cylinder 26 while simultaneously grasping and securing the body 12 of the lock 10. The features of the special tool required to produce this linear motion and the forces required to move the cylinder 26 a sufficient distance to disengage and reengage the toe 20 of the shackle 16 determines the nature of the security provided. One example of a special tool which may be used for this purpose is illustrated in FIGS. 3*a* and 3*b*.

Figure 3A:
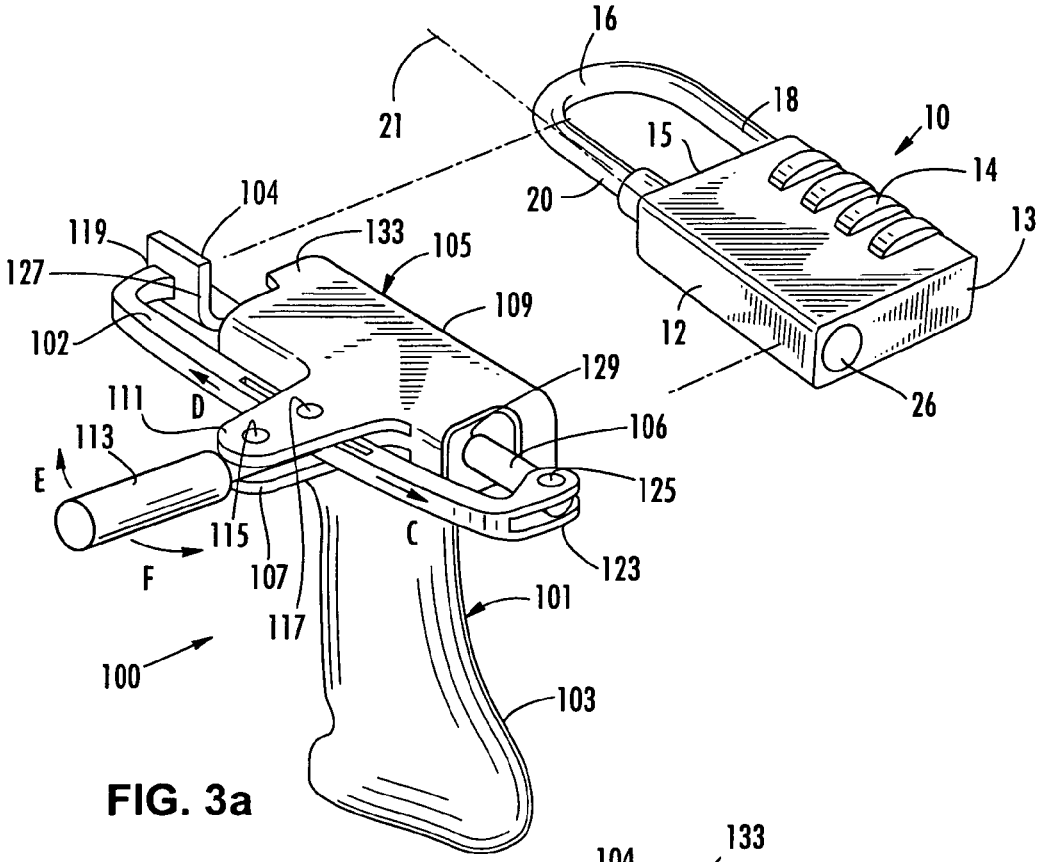
FIG. 3*a* depicts a perspective view of one embodiment a tool which may be utilized to unlock and lock the multiple function lock of FIG. 2*a* alongside a multiple function lock.
Figure 3B:
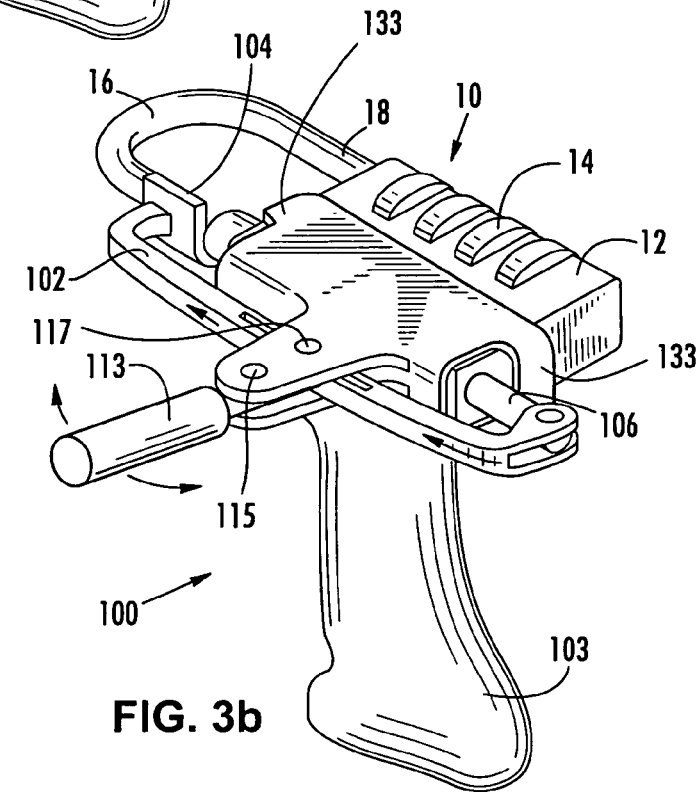
FIG. 3*b* depicts the tool of FIG. 3*a* engaged with the multiple function lock of FIG. 2*a;*

The tool 100 of FIGS. 3*a* and 3*b* provides many features. First, the engagement of the tool 100 with the body 12 of the lock 10 is preferably provided by producing a tool with a form of appropriate shape to assure necessary contact and registration with the body 12 surfaces. This engagement provides for the appropriate reactionary forces resulting from the action of the tool 100.

In addition, one will recall that the body 12 is preferably provided with a cylinder 26 within a clearance hole 24 concentric with the centerline 21 of the toe 20 of the shackle 16 and extending the length of the body from the base 13 through the top 15. The tool 100 may be provided with a movable element 102 to engage the cylinder 26. The clearance hole 24 may be of appropriate size relative to the cylinder 26 to assure freedom of motion between the movable element 102 and the body 12 with the requisite friction level for the intended application.

The tool 100 may be provided with an L-shaped device 104 to engage the toe 20 of the shackle 16. As shown in FIGS. 3*a* and 3*b*, the L-shaped device preferably includes an open side wall to permit entry of the toe 20 of the shackle 16. This L-shaped device 104 may be positioned around the shackle 16 of the lock 10 near the point of engagement of the shackle with the bored cylinder 26 that retains the secured toe 20. The moveable element 102 may also be hinged to release the toe 20 once the toe has been unlocked, although in preferred embodiments it need not be.

The tool 100 preferably engages tightly and firmly secures the body 12 of the lock 10. The tool 100 may provide for two independent but related functions. In the first function, this tool may cause a compressive force to move the bored cylinder 26 retaining the toe 20 of the shackle 16 along the centerline 21 of the secured shackle 16 from a point of protruding from the body 12 of the lock 10 at the top 15 to a point flush with the top 15 of the body. The opening provided by the L-shaped element 104 then allows for the exit of the toe of the shackle 16 by rotation of the shackle about its heel 18. The shackle 16 is then free to rotate to the open position permitting disengagement of the lock 10 from the attachment devices being secured.

In the second function, the reattachment of the lock 10 and rotation of the shackle 16 to reengage with the L-shaped device 104 provides for the relocking of the lock. The compression force, in this second function, acts to move the connecting element 106 within the body 12 against the displaced bored cylinder 26 to push the bored cylinder to the original secure position protruding from the top 15 of the body 12. The toe 20 of the shackle 16 is again securely retained within the bore 27, and the lock 10 secured.

An example of such a tool 100 is depicted in FIG. 3*a* alongside of a lock 10 of the type described with respect to FIGS. 2*a* and 2*b*. As shown in FIG. 3*a*, the tool 100 may comprise a tool body 101 forming a handle 103 extending from a lock engagement portion 105. The handle 103 may be adapted to be comfortably held by a human hand during manipulation of the tool 100. The lock engagement portion 105 may be adapted to secure a lock 10 while the lock is being locked and unlocked.

The lock engagement portion 105 may comprise an extension 107 on one side and an opening 109 into a cavity (not shown) on the other. The extension 107 may comprise a pair of flanges 111 extending away from the opening 109. A lever 113 may be rotatably mounted between the two flanges 111 by a pin 115 so that the lever may rotate between the two flanges.

The proximal end of the lever 113 may be attached to a moveable element 102, which may be moved in the direction of arrows C and D when the lever 113 is moved in the directions of arrows E and F. It will be appreciated the movement of the lever 113 in the direction indicated by arrow E will cause movement of the moveable element in direction C, which is opposite of the direction indicated by arrow E. To ensure that the lock body 12 remains within the tool 100, the tool may be provided with tabs 133 extending from the lock engagement portion 105 in the directions indicted by arrows C and D. The tabs 133 are preferably shaped such that one tab contacts the top 15 and another contacts the bottom 13 of the lock body 12, thus preventing the lock body from shifting in the directions indicated by arrows C and D. In this regard, the lock body 12 is preferably only permitted to linearly advance into the engagement portion 105 through opening 109.

The lever 113 generally rotates about pin 115 while movement of the moveable element 102 is generally linear in either the C or D directions. To guide the moveable element 102 in its linear path, a guide pin 117 may be provided. The guide pin 117 may extend through both the moveable element 102 and either one or both of the flanges 111. At its first end 119, the moveable element may include an L-shaped element 104. The L-shaped element 104 may be adapted to permit the toe 20 to rest against its open wall 121 such that a bearing surface 127 may abut the cylinder 26, as will be described. At its second end 123, the moveable element 102 may have a connecting element 106 attached thereto by a pin 125.

In one embodiment of the tool 100 shown in FIG. 3*a*, the connecting element 106 is shown as a rod; however, other configurations of connecting elements may be utilized. The connecting element 106 may include an end portion 129 typically shaped in registration with, or slightly smaller than, the bored cylinder 26 adjacent the bottom 13 of the lock 10. Alternatively, the connecting element 106 may include a separate element (not shown) designed to engage the bored cylinder 26. The separate element may take the form of a pressure plate, a shaped element, or other configurations and constructions. The separate element may also be provided with engaging members capable of positively engaging the cylinder 26 such that tension may be applied to the cylinder to pull the cylinder from within the body 12 of the lock 10. For example, the connecting element may include a quarter-turn device. Upon entry of the quarter-turn device into a suitable cavity (not shown) provided in cylinder 26, the quarter-turn device may be turned to lock it in place. The cylinder 26 may then be withdrawn from within the lock 10 body 12 to pull the cylinder 26 out toward base 13. If so provided, the tool 100 may not include L-shaped element 104, as tensile force will pull the cylinder 20 from the lock 10 body 12 rather than being pushed by compressive force provided by the L-shaped element 104.

It will be appreciated that operation of the tool 100 serves to lock or unlock the lock 10. Generally, the tool will be utilized by security personnel to open a lock 10 which has been locked by a traveler. The opening function provided by the tool 100 is therefore secondary to the principal locking function, which in the embodiment of FIG. 3*a* is shown to be a keyless, or combination mechanism 14. Alternatively, the principal locking function may be by use of a key or tool, as previously discussed.

For security purposes, particularly with regard to luggage, the tool 100 may be designed such that once a lock 10 is unlocked by use of the tool, the lock will be retained within the tool until such time that the lock is re-locked. Accordingly, in certain embodiments, only a locked lock 10 may be permitted to be secured or released by the tool 100, not an unlocked lock. In this regard, a higher level of security for the tool 100 will be provided as retaining of a given lock 10 by the tool 100 will prevent the same tool from being used to open a different lock, thus increasing the likelihood that a given lock will be replaced on the luggage from where it came.

As discussed in other embodiments of the present invention, a tool may be utilized to reveal one or more subsequent locking mechanisms rather than to directly open the lock. In such embodiments, one of the subsequent locking mechanisms may be operative to unlatch the toe of the shackle in the novel manner described.

Figure 4A:
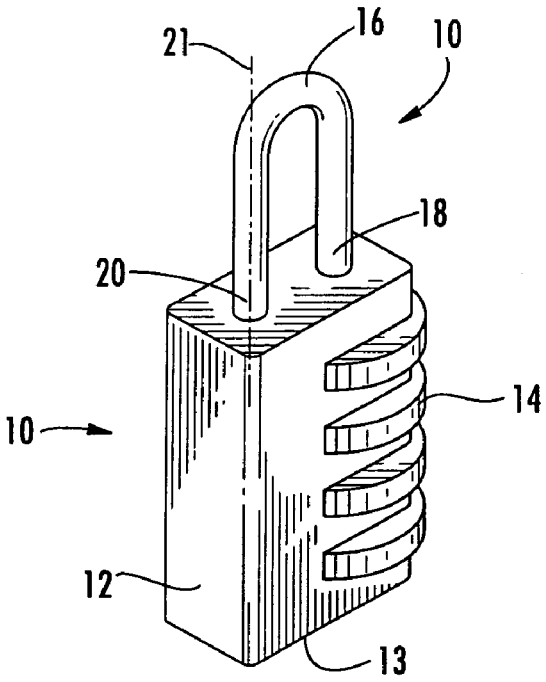
FIG. 4*a* is a perspective view of a multiple function lock in accordance with another embodiment of the present invention shown in the locked position.
Figure 4B:
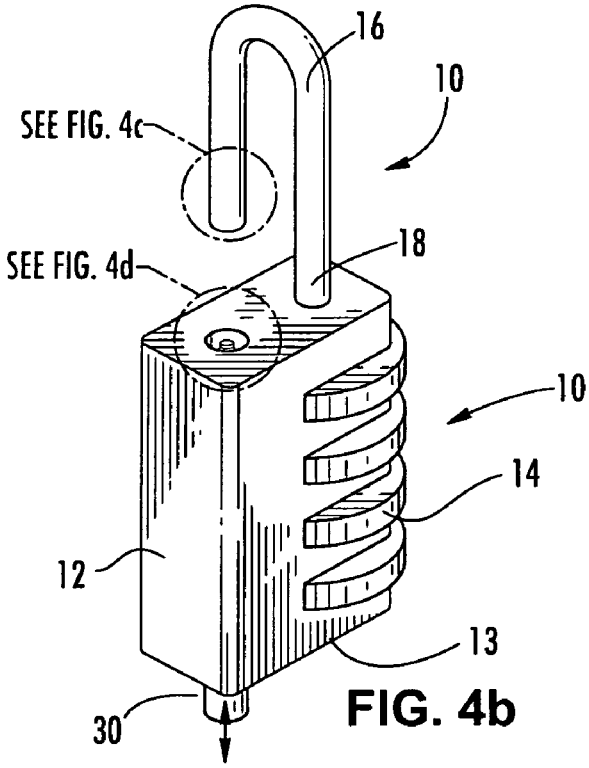
FIG. 4*b* is a perspective view of the multiple function lock of FIG. 4*a* shown in the unlocked position.
Figure 4C:
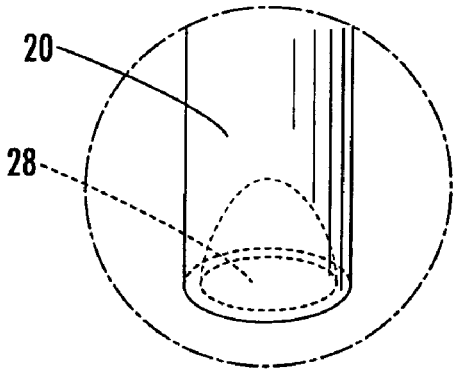
FIG. 4*c* depicts a blown up view of the toe of the shackle forming a portion of the multiple function lock of FIG. 4*a;*
Figure 4D:
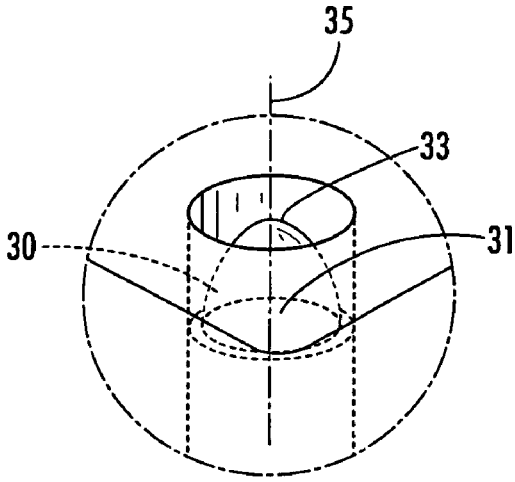
FIG. 4*d* depicts a blown up view of a portion of the body of the multiple function lock shown in FIG. 4*a;*

A further embodiment of the novel multiple function lock 10 provides for the internal engagement of a pin-like element within a hollowed toe 20 of the shackle 16. As shown in FIGS. 4*a* through 4*d*, the shackle 16 may incorporate a shaped cavity 28 (FIG. 4*c*) formed within the toe 20 concentric with the centerline 21 and of a depth sufficient to accommodate a vertically movable and mating pin-like element 30 (FIG. 4*d*). The pin-like element 30 may be located along the same alignment as the concentric cylinder 26 of the first embodiment within the clearance hole 24. The pin-like element 30 may also be free to move vertically along the centerline 21 of the toe 20 of shackle 16. This motion should be of sufficient distance to provide for engagement and disengagement of the toe 20 from the pin-like element 30.

Typically, the toe 20 of this embodiment may rotate about the heel 18, but need not be provided with provisions to permit insertion within the body 12 of the lock 10. Rather, when aligned above the pin-like element 30, the toe 20 may receive the pin-like element to lock the toe in place. When so engaged, the shackle 16 will be restricted from rotation about the heel 18 and will be secured, as shown in FIG. 4*a*. The shackle 16 may be free to rotate away from said engagement by retreat of the pin-like element 30 into the body 12 of the lock 10, as shown in FIG. 4*b*. When disengaged, the toe 20 of the shackle 16 may be free to rotate about the heel 18 to the open position.

As shown in FIG. 4*d*, the pin-like element 30 may be shaped to assist with fitting the pin-like element into the toe 20. For example, the pin-like element 30 may include a tapered section 31 at its proximal end 33 reducing the diameter of the pin-like element 30. Such reduction permits the pin-like element 30 to engage the shaped cavity 28 of the toe 20, which may be shaped with a corresponding taper. It will be appreciated that the tapered section 31 permits the engagement of the pin-like element 30 with the toe 20 even when the toe is slightly off axis, such as if the centerline 21 of the toe 16 were not in absolute alignment with the centerline 35 of the pin-like element 30. Further advancement of the pin-like element 30 into the toe 20 will then draw the toe into alignment with the centerline 21, by virtue of the mutually tapered configurations. Ideally, however, the centerline 21 of the toe 20 is in near absolute alignment with the centerline 33 of the pin-like element 30 prior to any attempt to position the pin-like element within the toe to capture the toe.

The features of the special tool adapted to induce the linear motion described with respect to this embodiment may be similar to those described previously with respect to tool 100. Nevertheless, the tool may differ in that at least the engagement with the moving element of the lock 10 (the pin-like element 30) may be achieved solely at the bottom of the lock body 12 near base 13. When engaged with the moving element (the pin-like element 30), the tool may provide the necessary force along the axis of the pin-like element 30 to disengage and reengage the toe 20 of the shackle 16 to secure the lock 10. These forces include both compressive forces to force the pin 30 into the toe 20 to lock the toe in place, and tensile forces to pull the pin from within the cavity 28 of toe 20. In order to provide such tensile forces, the specialized tool may be equipped with a quarter-turn device adapted to engage the moving element, which may be fabricated or machined for such purpose. The tool may also be provided with other arrangements suitable for this purpose, such as fully threaded couplings or specially adapted shaped fittings.

Figure 5A:
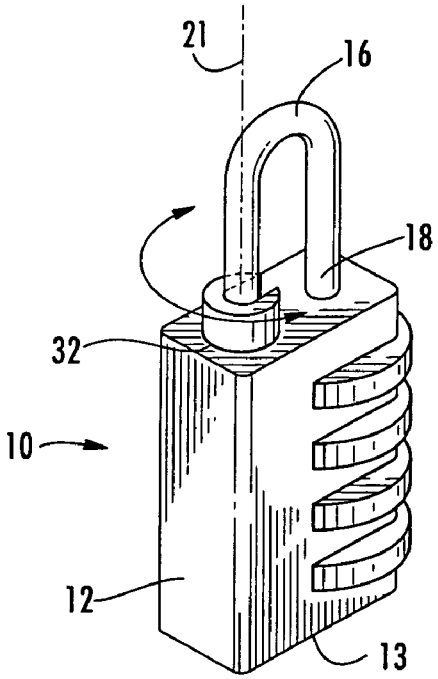
FIG. 5*a* depicts a perspective view of a multiple function lock in accordance with another embodiment of the present invention shown in a locked position.
Figure 5B:
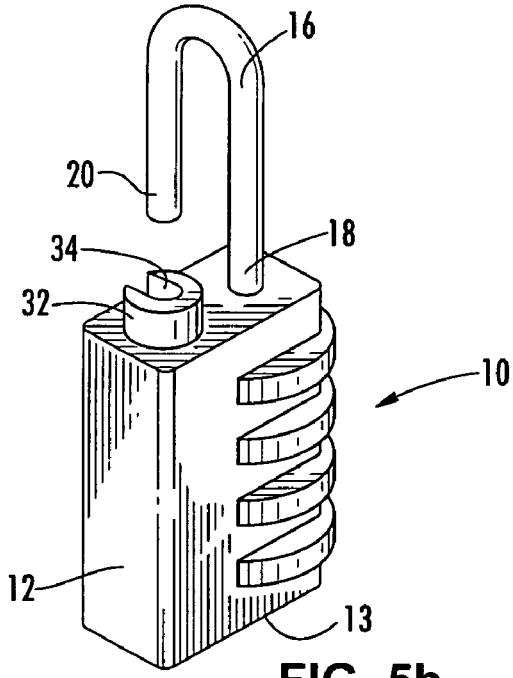
FIG. 5*b* is a perspective view of the multiple function lock of FIG. 5*a* shown in the unlocked position with the shackle fully open.

A further embodiment of the novel multiple function lock incorporates the novel elements of this invention to achieve the secure control of the shackle toe 20 within an interrupted cylinder 32, through rotation of the cylinder. As shown in FIGS. 5*a* and 5*b*, in this embodiment, an interrupted cylinder 32 may rotate about the centerline 21 of the toe 20 of the shackle 16 to selectively lock and unlock the toe portion of the lock 10. In other embodiments, the interrupted cylinder may rotate about a point offset from the centerline 21 while functioning in the same manner. To form the interrupted cylinder 32, a cylinder may be provided with a gate or simple opening 34 through the wall of the cylinder of a dimension so as to permit the clearance of the toe 20 of the shackle 16 when the cylinder is rotated to the open position. The open position of the lock of this embodiment is shown in FIG. 5*b*. As is shown, the lock may be unlocked by rotating the shackle 16 about the heel 18. The toe 20 of the shackle 16 is then free to engage or disengage with the elements of the hasp or attachment to which the lock was secured. Once the toe 20 is returned back into position within the interrupted cylinder 32, such as by passing through opening 34 so the centerline 21 of the toe 20 aligns with the centerline 35 of the interrupted cylinder 32, the interrupted cylinder may be rotated to an angle sufficient to secure the toe 20 therein. This angle is preferably 90 degrees, but need only be sufficient to capture the toe 20 to prevent its release.

As with the previous embodiments, the interrupted cylinder 32 of this embodiment may be a simple roll pin, so long as the gap in the pin is sufficiently large to form opening 34 to permit the toe 20 to pass. Alternatively, the upper portion of the roll pin may be cut during the manufacturing process to provide the requisite access for the toe 20 of the shackle 16. The interrupted cylinder 32 may also be a simple cylinder with a machined or cast recess or a combination of elements forming a similar structure. In addition, the clearance hole 24 in this embodiment may not be formed completely through the body 12 of the lock 10. Rather, only a minimal depth to secure the interrupted cylinder 32 is required. Of course, the depth that the interrupted cylinder 32 is inserted may affect the friction force required to rotate the interrupted cylinder to unlock the lock.

Figure 5C:
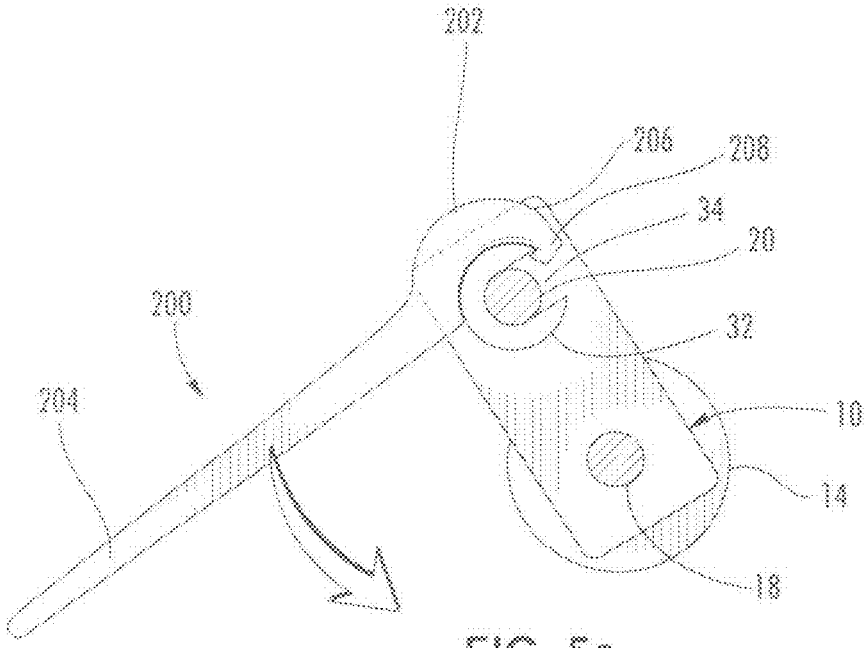
FIG. 5*c* depicts a spanner wrench engaged with the rotatable cylinder of a lock in accordance with the embodiment of FIG. 5*a;*

The special tool required to cause this rotational motion and the torsional forces required to place the interrupted cylinder 32 in the closed or open position may be as simple as a spanner wrench, such as spanner wrench 200 shown in FIG. 5*c*. As generally known in the art, a spanner wrench 200 may include a head portion 202 extending from a handle 204. The head portion 202 may form the shape of a C. The distal end 206 of the head portion 202 may form into a knob 208. The knob 208 is preferably adapted to engage the interrupted cylinder 32 of the lock 10 from within the opening 34, as shown in FIG. 5*c*. It will be appreciated that rotation of the spanner wrench 200 will similarly rotate the interrupted cylinder 32, thus permitting or denying passage of the toe 20 through the opening 34. To facilitate use of the spanner wrench 200, the user should adequately secure the lock 10 within his grasp or within a vice or similar apparatus. In other embodiments, the tool used to rotate the interrupted cylinder 32 is a simple key inserted into the cylinder at the base 13 of the lock. The key may then be rotated to effect rotation of the interrupted cylinder 32 and locking or unlocking of the lock 10. Other tools providing a similar function may also be utilized.

Figure 6A:
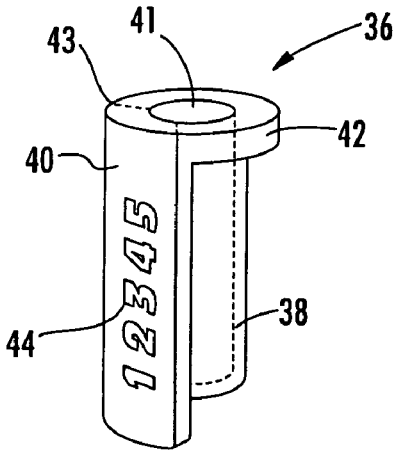
FIG. 6*a* is a perspective view of a frangible element used in conjunction with a multiple function lock in accordance with further embodiments of the present invention.
Figure 6B:
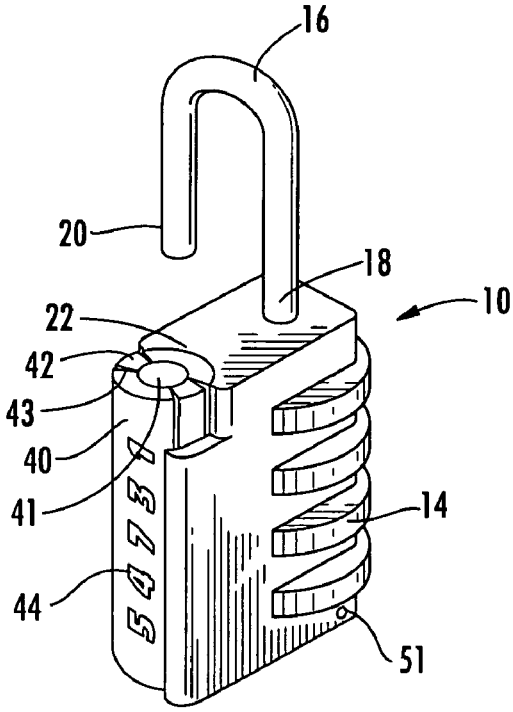
FIG. 6*b* is a perspective view of a multiple function lock capable of being used with a frangible element in accordance with another embodiment of the present invention shown in the open position.

A further embodiment of the novel multiple-function lock incorporates the novel elements of this invention to achieve the secure control of the shackle toe 20 within a bored cylinder much as in the previous embodiments. In this embodiment, however, the bored cylinder is formed from a frangible element 36. As used herein, the term frangible shall be construed broadly to include at least those elements which are readily or easily broken, brittle, or which are capable of being broken. FIG. 6*a* depicts a typical frangible element 36 of the present invention while FIG. 6*b* depicts a similar frangible element 36 installed within a lock 10.

As shown in FIG. 6*a*, the frangible element 36 may comprise a frangible cup 42 connecting a base section 38 to a label section 40. The base section 38 may be designed to be installed into the clearance hole 24 of a lock body 12. Once installed, the frangible cup 42 will reside in the area directly below the toe 20 of the shackle 16, when the lock 10 is in the locked position, such that the toe may be retained within the bore 41.

Once locked, the lock 10 may be opened in one of two ways. The first method is the conventional method of releasing the heel 18 by, for example, the keyless (combination) element 14 depicted in FIG. 6*b*. The second method is by way of fracturing the frangible cup 42 by applying a sufficient torsional force upon the toe 20 of the shackle 16. The fracturing method is, of course, destructive. Once opened in this manner, a second frangible element 36 must be installed into the lock 10 in order to re-lock the shackle 16. In order to install a new frangible element 36, it may be necessary to slide the new frangible element 36 partially up the shackle 16, so the frangible cup 42 may clear the lock body 12 as the frangible element swings by. Once above its final resting position, the frangible element 36 may be slid back down the shackle 16 and into position within the body 12.

A unique identifier 44, such as a number, bar code, or symbol, may be included on the label section 40 so a traveler or other user may readily identify that the lock 10 had been opened. Alternatively, the original frangible element 36 may be replaced by a second frangible element of a particular color only provided to certain groups or individuals. In other embodiments, radio frequency identifier tags may be utilized.

It will also be appreciated that the frangible element 36 need not be replaced at all. In certain situations, it may be preferable for the entire lock 10, with the fractured frangible element 36, to be placed within the container originally being secured by the lock. The container may then closed and returned to the traveler. Preferably, the container will first be sealed with a PRIVASEAL® protective seal, or the like, before being returned.

Typically, the frangible elements 36 will be formed from plastic, paper, cardboard, fiber impregnated resins, or the like. The strength and thickness of the material will determine the torsional load that is required to fracture the frangible cup 42. It will be appreciated that the torsional load is preferably less than the load required to bend the shackle 16, such that the frangible cup 42 fractures before the shackle bends. While a specialized tool may be utilized to fracture the frangible cup 42, a simple pry bar biased against the heel 18 and the toe 20 of the shackle 16 may be sufficient to fracture the frangible cup in most applications. The frangible cup may also include scored or other weakened areas 43 to permit easier or controlled fracture.

Figure 6C:
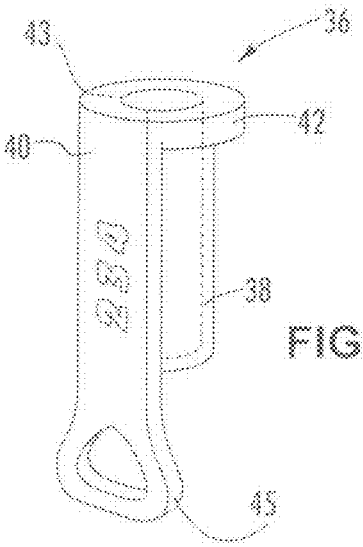
FIG. 6*c* depicts a perspective view of a frangible element in accordance with another embodiment of the present invention.

Frangible elements 36 may also include self-contained means to fracture or otherwise compromise the structure integrity of the frangible element. For example, FIG. 6*c* depicts a frangible element 36 having many of the features of the embodiment shown in FIG. 6*a*, including a base section 38 connected to a label section 40 by a frangible cup 42. As with the embodiment shown in FIG. 6*a*, the frangible element 36 of FIG. 6*c* is designed to be installed with its base section 38 inserted in the clearance hole 24 of a lock body 12. In addition to those elements however, the frangible element 36 of FIG. 6*c* also includes a pull tab 45 extending from an end of the label section 40 distant from the frangible cup 42. The pull tab 45 may be lifted so as to fracture the frangible cup 42 at scored areas 43. In this regard, no secondary device is required to unlock the lock 10 at the toe 20. To ease such pulling, the pull tab may be provided with an aperture 46 in which a user may insert a finger. Further, the length of the pull tab 45, the materials of construction, and the extent to which the scored areas 43 are weakened may be engineered to alter the tensile forces required on the pull tab prior to fracture. Each of these may be modified to provide the strength required for a given application.

Figure 7:
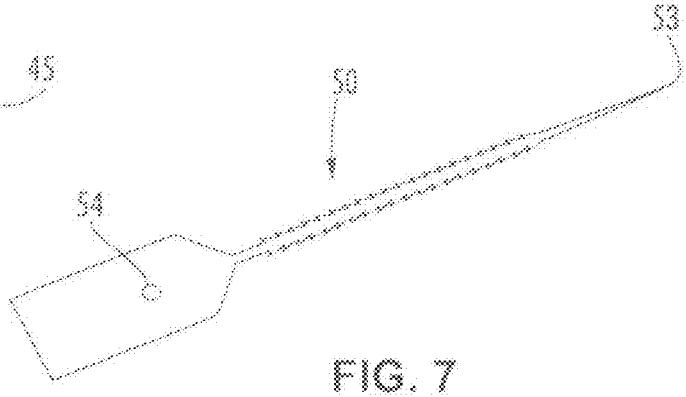
FIG. 7 depicts a plan view of a typical tamper indicative device (seal) which may be used in conjunction with the multiple function locks of the present invention.

Each of the locks 10 described throughout this entire specification may also be provided with tamper indicative devices. A typical tamper indicative device is shown in FIG. 7. This tamper indicative device 50 is a single use pull tight seal, or zip tie, as is known in the industry. As shown in FIG. 6*b*, a lock 10 may be provided with a through hole 51 extending through the body 12 and the heel 18. The first end 53 of a tamper indicative device 50 may then be threaded through the body 12 and heel 18, and secured by pulling tight through a one-way aperture 54 provided on the tamper indicative device 50. The tamper indicative device may also be simply passed through the aperture. Once so installed, the lock 10 may not be opened, either through the conventional heel-lifting manner or through any of the novel rotational manners described herein, without rupturing the tamper indicative seal 50. As with the label element 40, tamper indicative seals 50 may be provided in a variety of colors, each associated with a particular group or individuals, and may be emblazoned with a unique identification number, bar code, or symbol.

Other tamper-evident devices may also be utilized. For example, with respect to some embodiments, a label may be affixed to the body 12 of the lock 10 such that the label will be ruptured if the bored cylinder 26 or the pin-like element 30 is permitted to extend beyond the base 13 of the body 12, such as when the lock 10 of these embodiments is opened using the novel toe-releasing teachings of this invention. It will be appreciated, however, that such a label may not indicate tampering or opening of the lock 10 using the conventional heel-releasing mechanism.

Figure 8A:
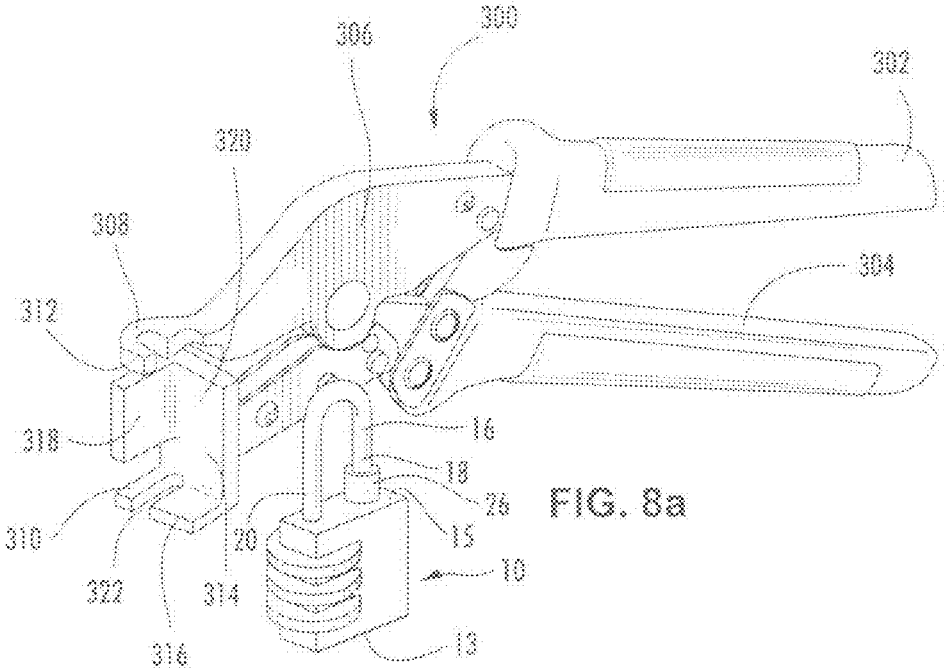
FIG. 8*a* depicts a perspective view of another embodiment of a tool which may be utilized to unlock and lock the multiple function lock of FIG. 2*a* alongside a multiple function lock.

FIG. 8*a* depicts another preferred embodiment of a tool which may be utilized to unlock the second locking mechanism of locks constructed in accordance with the teachings of the present invention. In FIG. 8*a*, a lock 10, of the type shown and described with respect to FIGS. 2*a* and 2*b* is shown alongside the tool 300. As previously discussed, the lock 10 comprises a lock body 12 and an attached shackle 16. The shackle 16 includes a toe portion 18 and a heel portion 20. At the toe portion 18 of the shackle 16, a cylinder 26 may slide within the body 12 of the lock 10, to selectively capture or release the toe 20 of the shackle 16. The cylinder 26 is preferably sized to penetrate either the top 15 or bottom 13 of the lock body 12, at any given time.

The specialized tool 300 comprises an upper handle 302 and a lower handle 304 hinged together by a hinge assembly 306. The hinge assembly 306 is in turn connected to an upper jaw 308 and a lower jaw 310 in a scissor-like engagement. The hinge may be designed with a ratchet mechanism (not shown) which positions the jaws 308, 310 in proximity to each other upon repeated ratcheting of the handles 302, 304. The ratchet mechanism may then be released to permit the jaws 308, 310 to open, such that they are apart from each other. Such ratchet mechanisms are known in the art, and may be similar to those utilized in ratcheted crimping tools commonly available.

It will be appreciated that the number of ratchet sweeps, or handle pumps, required to completely close the jaws 308, 310 may be engineered in accordance with the compression load required by the lock 10 to overcome the resistance of the cylinder 26 within the body 12. For locks 10 that only require a relatively light load, the lock may be opened in a single pump. For higher security locks 10, multiple pumps may be required to provide the excursion distance required to unlock the lock 10 without the need for an abundant amount of force at the handle 302, 304. In each case, the length of the handles 302, 304 will also be a factor.

Figure 8B:
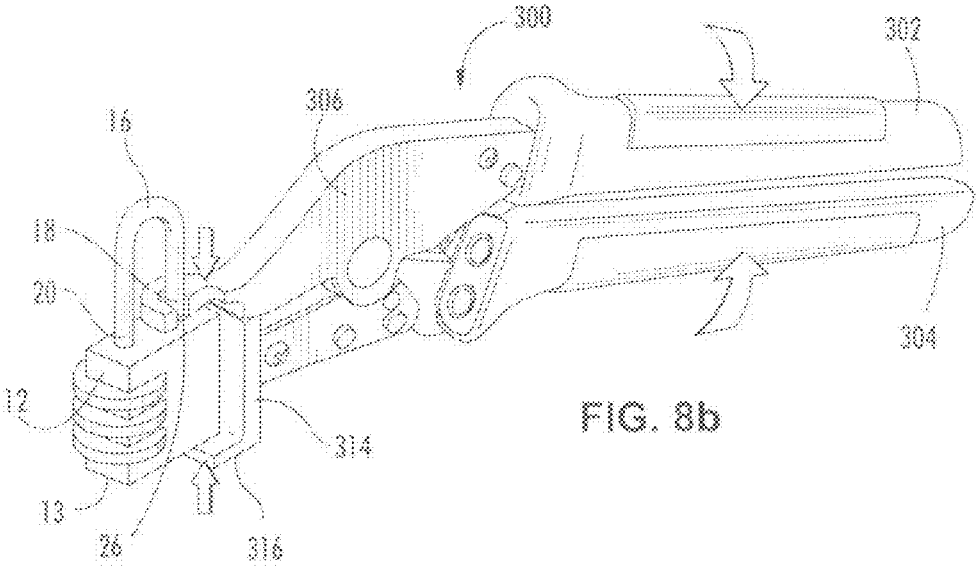
FIG. 8*b* depicts the tool of FIG. 8*a* engaged with the multiple function lock of FIG. 2*a* in a position for unlocking the lock.

To unlock a lock 10, the lock may be positioned between the upper jaw 308 and the lower jaw 310, when the jaws are spaced apart, as shown in FIG. 8*b*. The toe 18 of the shackle 16 may then be placed within the upper jaw 308 such that a U-shaped engagement cup 312 is above cylinder 26, which in an unlocked lock 10 is raised above the top 15 of the lock body 12. In the meantime, the body 12 of lock 10 may be positioned within the lower jaw 310 such that the body of the lock rests within a support 314 formed from the lower jaw 310.

Preferably, the support 314 comprises a lower bracket 316 and a sidewall 318 extending perpendicularly from a back wall 320. The sidewall 318 and the lower bracket 316 are typically at an angle normal to each other, such that the sidewall extends linearly between the lower bracket and the upper jaw 308.

Figure 8C:
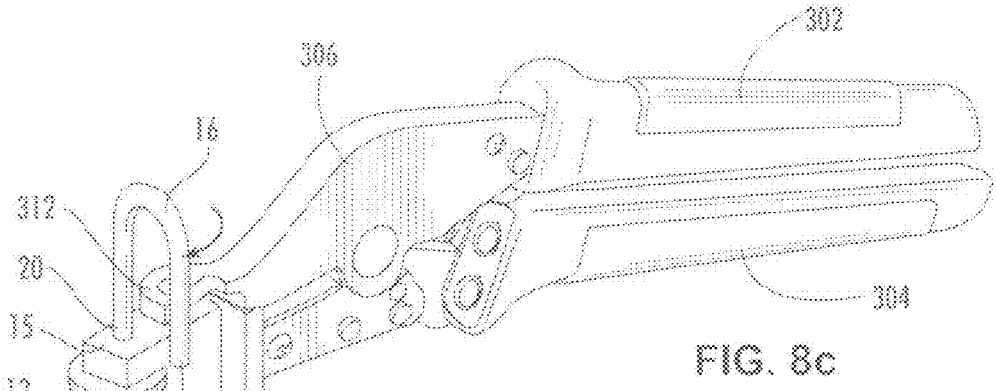
FIG. 8*c* depicts the tool of FIG. 8*a* engaged with the multiple function lock of FIG. 2*a* where the lock is unlocked and opened.

Once in this position, the ratcheted handles 302, 304 may be pumped such that the lower jaw 310 and the upper jaw 308 are brought into proximity to each other. Such action causes the engagement cup 312 to push against the cylinder 26, thus pushing the cylinder into the body 12 of the lock 10, as shown in FIG. 8*b*. As shown in FIG. 8*c*, the shackle 16 of the lock 10 may then be swung open and the lock unlatched. Although not shown, it will be appreciated that the portion of cylinder 26 protruding from the bottom 13 of lock 10 may pass through a slot 322 (FIG. 8*a*) provided in the lower bracket 316 when the lock is opened by releasing the toe 18. Once the lock 10 is opened, it may be disengaged from the tool 300 and manipulated as desired for the application.

Figure 8D:
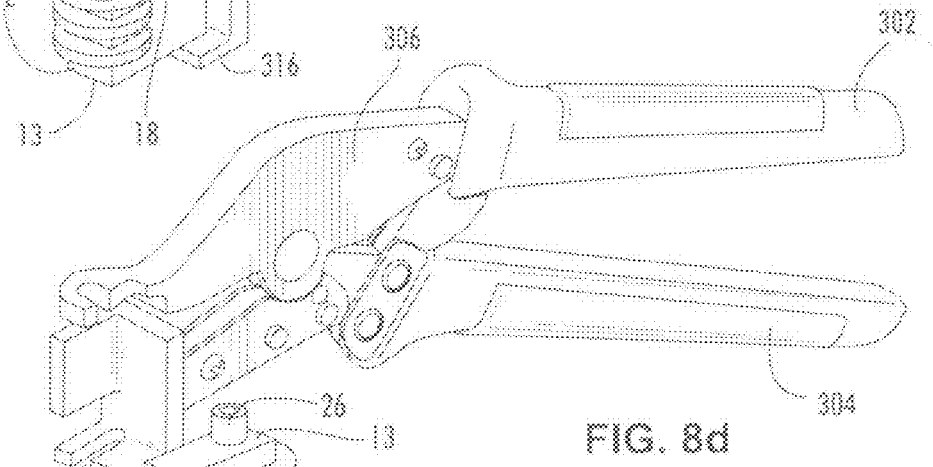
FIG. 8*d* depicts the tool of FIG. 8*a* alongside an open lock of the type shown in FIG. 2*a* in an upside-down position; and, FIG. 8*e* depicts the tool of FIG. 8*a* engaging a lock of FIG. 2*a* in an upside-down position so as to lock the lock.
Figure 8E:
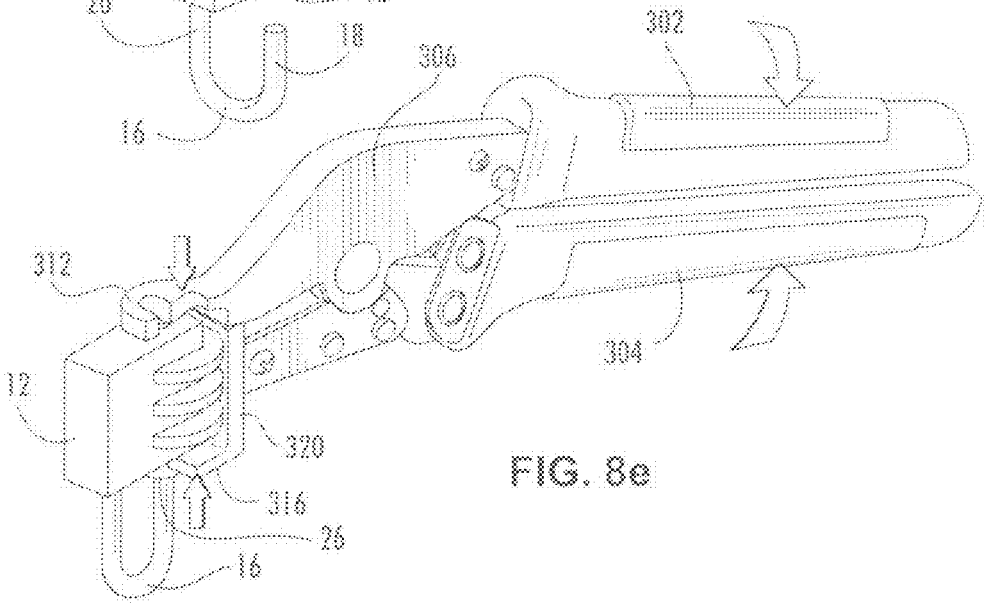

In order to lock the lock 10, the lock may be flipped upside-down such that the cylinder 26 penetrating the bottom 13 of the lock is facing toward the upper jaw 308, as shown in FIG. 8*d*. The lock 10 may then be inserted between the upper jaw 308 and the lower jaw 310 such that the toe 18 of the shackle 16 is aligned with the cylinder 26. Ratcheting of the handles 302, 304 will therefore cause the jaws 308, 310 to squeeze together, thus driving the cylinder 26 through the top 15 of the lock to capture the toe 18, as shown in FIG. 8*e*.

It will be appreciated that the ratcheting device 300 shown and described herein may exert a large force upon cylinder 26 to drive the cylinder through the body 12 of the lock 10. As known with such ratcheting devices, one stroke of the handle 302, 304 may impart a certain excursion of the jaws 308, 310. The gear ratio between the two may be engineered such that the handle stroke requires only the amount of force that the designer intends, which is preferably much less than would be otherwise required without the mechanical advantage offered by such a tool. Preferably, the number of strokes required to complete the unlocking or locking of a lock 10 is not so great as to inhibit the timeliness of an application, or to invoke more strokes than is necessary. In this regard, an appropriate balance between the number of strokes and the force required is preferably made in accordance with design parameters deemed appropriate for the given application. It will be appreciated, however, that other tools, such as non-ratcheting tools, may also be utilized. Non-ratcheting tools are particularly preferred in applications where the mechanical advantage offered by the length of the handles 302, 304 is sufficient to overcome the force required to move the cylinder 26, without the need for ratcheting devices to impart additional mechanical advantage as non-ratcheting tools are often lighter, less complicated, and generally easier to use. It is also anticipated that the tool may be power driven, for example by electric, pneumatic, or hydraulic power.

The tool 300 shown and described with respect to FIGS. 8*a* through 8*e* is designed to easily release the lock 10 when the lock is opened. However, in other embodiments, tools may be adapted to effectively secure the lock 10 when the lock is opened, such that the tool may not be utilized again until the captured lock is locked and released. In certain applications, this type of tool is preferred so that a single tool may not be used to unlock multiple locks, without the first unlocked lock being relocked.

Each of the disclosed embodiments contemplates the provision of an alternative security mechanism involving special tools to unlock the toe portion of the shackle in addition to an opening mechanism of the conventional type to lock the heel. Such locks would provide for a method of security not available from key, keyless or onetime use tamper indicative devices. The associated tools may be designed so as to be difficult to replicate and/or of substantial size, such that they are difficult to hide. The tools may also be distributed so as to be available only as determined by the appropriate authority.

It will be appreciated from the disclosure that the tools, in addition to actually opening the locks, preferably assist in securing the lock during the opening process. In addition, the tools may be designed such that the open lock is retained within the tool until such time that the lock is relocated and secured in a locked position.

Several embodiments of the novel lock provide for using linear motion to accomplish the unlocking and unlatching functions. This motion would free the secured toe of the shackle to permit rotation to move the shackle and open the lock. Other embodiments require rotational motion to open a gate to permit the toe of the shackle to rotate free of the cylinder, permitting the lock 10 to open. Rotation of the gate may or may not be about the centerline of the toe when secured within the body.

Each of these embodiments could be accomplished using a conventional key function lock mechanism in alignment with the centerline 21 of the toe 20 of the shackle 16 and located at the bottom 13 of the lock body 12 in lieu of a special tool locking mechanism at the toe. The conventional rotation of the plug of the lock cylinder with the appropriate connecting elements could cause the rotation of the cylinder 32 with opening 34. The use of a helix element as part of the mechanism with the appropriate connecting elements could cause the rotational motion of the lock cylinder plug to cause the linear motion required to open and close the lock with bored element 26 or pin-like element 30. The addition of this lock cylinder would result in the lock having two key function cylinders, or one key function and one keyless function (combination) device. It will also be appreciated that the keyed cylinder may be offset from the centerline 21 in certain embodiments. Further, and in addition to the above, each of the embodiments described could be provided with an attachment point for the use of a tamper indicative device (seal), including a label seal, to rupture or fracture if the security elements had been caused to function allowing the lock to be opened.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A multiple function lock comprising:

a body comprising a top surface and a bottom surface;

a shackle that is solid and rigid having a toe and a heel, the heel extending from the top surface and the shackle being retained by the body and able to rotate within the body;

a first lock to lock the heel of the shackle and a frangible captive element to capture the toe of the shackle, each of the first lock and the frangible captive element being enabled to independently open the multiple function lock;

the first lock being enabled to latch the heel inside the body in a locked state and to unlatch the heel allowing the shackle to be partially lifted from the body along a centerline of the shackle at the heel into a rotatable unlocked state, and the frangible captive element being enabled to secure and to release the toe wherein the toe in the locked state of the first lock is positioned between a level defined by the top surface and the bottom surface of the body and the toe in the unlocked state of the first lock and in a locked state of the frangible captive element is not positioned between the level defined by the top surface of the body and the bottom surface of the body; and the frangible captive element having a retaining structure that holds the toe of the shackle and prevents the shackle from rotating about the heel when the first lock is in locked state and the frangible captive element secures the toe.

2. The multiple function lock of claim 1, wherein the first lock is a combination lock.

3. The multiple function lock of claim 1, wherein said body and said toe form an aperture adapted to receive a tamper evident element.

4. The multiple function lock of claim 3, wherein said tamper evident element may be passed through said aperture.

5. The multiple function lock of claim 1, wherein said multiple function lock is adapted to accept an adhesive label applied thereto, said label adapted to rupture upon manipulation of said second lock.

6. The multiple function lock of claim 1, wherein the frangible captive element comprises a frangible part adapted to be fractured upon the application of a sufficient force thereupon.

7. The multiple function lock of claim 6, wherein said application of force is by rotation of said shackle about said heel.

8. The multiple function lock of claim 6, wherein said frangible part includes locally weakened areas to control the fracture characteristics of said frangible captive element.

9. The multiple function lock of claim 6, wherein said frangible captive element further comprises a pull tab adapted to fracture said frangible part upon pulling of said pull tab.

10. A padlock, comprising:

a body including a top surface and a bottom surface with a first distance between the top surface and the bottom surface;

a u-shaped shackle that is solid and rigid having a toe and a heel, the heel extending from the top surface and being retained by the body and able to rotate within the body;

a first lock and a frangible captive element to lock the shackle with the heel in a locked state and to secure the toe respectively, each of the first lock and frangible captive element being enabled to independently unlock the shackle;

the first lock is enabled to latch the heel inside the body in a locked state and to unlatch the heel allowing the shackle to be partially lifted from the body along a centerline of the shackle at the heel into a rotable unlocked state; and the frangible captive element is enabled to capture the toe in a position wherein a distance between the toe and the bottom surface is smaller than the first distance when the first lock latches the heel in the locked state, and the toe being free from the frangible captive element with the distance between the toe and the bottom surface being greater than the first distance with the first lock in an unlocked state and the frangible captive element in the locked state.

11. The padlock of claim 10, wherein the first lock is a combination lock.

12. The padlock of claim 10, wherein said frangible captive element comprises a frangible part adapted to be fractured upon the application of a sufficient force thereupon.

13. The padlock of claim 12, wherein said application of force is by rotation of the shackle about the heel.

14. The padlock of claim 12, wherein the frangible part includes locally weakened areas to control the fracture characteristics of the frangible captive element.

15. The padlock of claim 12, wherein the frangible captive element further comprises a pull tab adapted to fracture the frangible part upon pulling of the pull tab.

* * * * *